United States Patent [19]

Ayisi

[11] Patent Number: 5,026,072

[45] Date of Patent: Jun. 25, 1991

[54] METHOD OF PLAYING A PICK-A-CARD GAME

[76] Inventor: Gabriel A. Ayisi, 622 E. 59th St., Brooklyn, N.Y. 11234

[21] Appl. No.: 597,555

[22] Filed: Oct. 15, 1990

[51] Int. Cl.[5] ..... A63F 1/00

[52] U.S. Cl. ..... 273/308

[58] Field of Search ..... 273/308, 303–306

[56] References Cited

U.S. PATENT DOCUMENTS

| | | | |
|---|---|---|---|
| 1,174,783 | 3/1916 | Warrem | 273/308 |
| 2,296,904 | 9/1942 | Brown et al. | 273/308 |
| 4,315,628 | 2/1982 | Balash et al. | 273/308 |

OTHER PUBLICATIONS

Book of 1000 Family Games by Readers Digest, Jun. 18, 1973, pp. 36–38.

*Primary Examiner*—Benjamin Layno

*Attorney, Agent, or Firm*—Leon Gilden

[57] ABSTRACT

A game is presented for play by a plurality of players in a range of two to eight persons. A predetermined number of cards is provided and upon determination of an initial dealer, the cards are dealt sequentially by each player counter-clockwise as the deal is turned over to an adjacent player to one's right of the current dealer. A predetermined number of such cycles are determined prior to commencement of play. The cards are shuffled and cards provided with a variety of differing symbols are passed to an adjacent player to the dealer's right. A preselected card or goal card is determined by the dealer and the adjacent player must then attempt to select that particular card. Scoring is awarded based on decreasing value dependent upon the number of attempts a player requires to select the goal card. Scoring and representative money is utilized throughout the game, and upon completion of the predetermined number or cycles, a winner is determined.

4 Claims, 4 Drawing Sheets

11
12
13
STAR
SQUARE
CIRCLE
14
15
16
TRIANGLE
ARROW
MOON
17
18
19
CROSS
FOOTBALL
ASTERISK

FIG 2
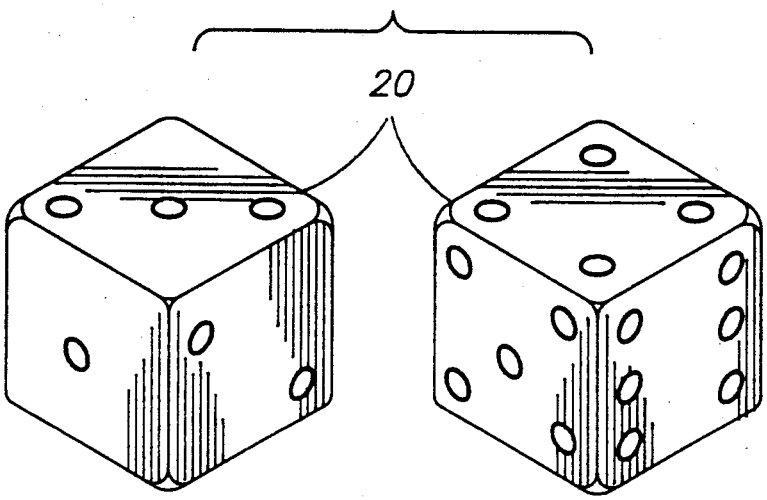
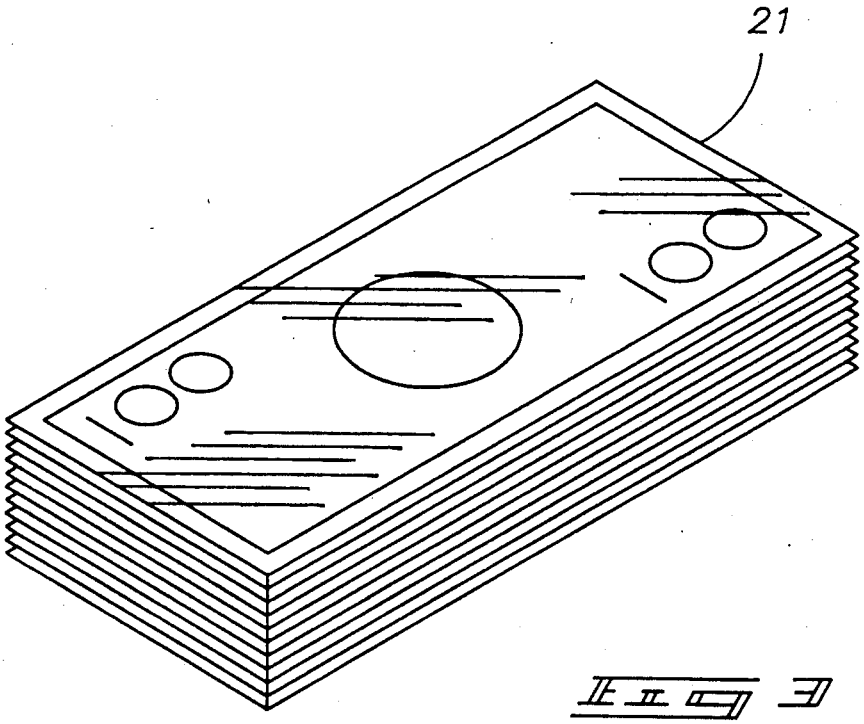
FIG 3

22

| 24 PLAYER | 25 NUMBER OF TIMES PLAYED | 26 POINTS WON TO DATE | 27 POINTS LOST TO DATE | 28 NET POINT IN FAVOR | 29 RANKING |
|---|---|---|---|---|---|
| (NAME) | | | | | |
| (NAME) | | | | | |
| (NAME) | | | | | |
| (NAME) | | | | | |
| (NAME) | | | | | |
| (NAME) | | | | | |
| (NAME) | | | | | |
| (NAME) | | | | | |

Fig 4

| PLAYER (24) | # OF TIMES PLAYERS TO DATE (25) | POINTS WON (26) | | | DRAW (30) | POINTS LOST (27) | | | NET POINTS IN FAVOR (28) | RANKING (29) |
|---|---|---|---|---|---|---|---|---|---|---|
| | | +4 | +3 | +2 | +1 | 0 | −1 | −2 | −3 | −4 | | |
| (NAME) | | | | | | | | | | | | |
| (NAME) | | | | | | | | | | | | |
| (NAME) | | | | | | | | | | | | |
| (NAME) | | | | | | | | | | | | |
| (NAME) | | | | | | | | | | | | |
| (NAME) | | | | | | | | | | | | |
| (NAME) | | | | | | | | | | | | |
| (NAME) | | | | | | | | | | | | |

FIG. 5

METHOD OF PLAYING A PICK-A-CARD GAME

BACKGROUND OF THE INVENTION

1. Field of the Invention

The field of invention relates to card playing games, and more particularly pertains to a new and improved card game wherein the same presents a random determination of game cycles and card selection to determine an ultimate winner in the game.

2. Description of the Prior Art

Card playing games of various types have been provided by the prior art. Card games have even been developed for electronic play utilizing contemporary printed circuitry and memory chip components within a compact unit to permit selective play and representative gaming utilizing representative cards. The instant invention attempts to provide a unique and readily and conveniently presented card game with associated challenges and suspense to promote interest and amusement for individuals participating. The instant invention is also subject to play by computer representative games as developed by the prior art. Prior art examples of electronic card-type games are typified for example in U.S. Pat. No. 4,314,336 to Bernstein, et al., providing a portable electronic card game simulator playing various card games and utilizing circuitry to maintain scoring within the game.

U.S. Pat. No. 4,339,134 to Macheel sets forth an electronic card game simulator utilizing a compact hand-held housing and programming to simulate Black Jack against a phantom dealer.

U.S. Pat. No. 4,162,792 to Chang, et al., sets forth a computer simulator to simulate various games, such as automobile racing, football, and the like.

U.S. Pat. No. 4,380,334 to Minkoff sets forth a further electronic card game simulator simulating Gin Rummy in operation and associated circuitry therefor.

U.S. Pat. No. 4,249,735 to Bromley sets forth an electronic football game simulator utilizing comparative circuitry to permit play of such game.

As such, it may be appreciated that there continues to be a need for a new and improved card game as set forth by the instant invention wherein the same addresses both the problems of ease of understanding, as well as convenience in play as well as ease of adaptability to electronic card game simulation and in this respect, the present invention substantially fulfills this need.

SUMMARY OF THE INVENTION

In view of the foregoing disadvantages inherent in the known types of card games now present in the prior art, the present invention provides a method of playing a pick-a-card game wherein the same utilizes a random number of cycles utilizing a predetermined number of players to provide amusement and gaming risk in the play of the game. As such, the general purpose of the present invention, which will be described subsequently in greater detail, is to provide a new and improved pick-a-card game which has all the advantages of the prior art card games and none of the disadvantages.

To attain this, the present invention provides a game for play by a plurality of players in a range of two to eight persons. A predetermined number of cards is provided and upon determination of an initial dealer, the cards are dealt sequentially by each player counter-clockwise as the deal is turned over to an adjacent player to one's right of the current dealer. A predetermined number of such cycles are determined prior to commencement of play. The cards are shuffled and cards provided with a variety of differing symbols are passed to an adjacent player to the dealer's right. A preselected card or goal card is determined by the dealer and the adjacent player must then attempt to select that particular card. Scoring is awarded based on decreasing value dependent upon the number of attempts a player requires to select the goal card. scoring and representative money is utilized throughout the game, and upon completion of the predetermined number or cycles, a winner is determined.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved pick-a-card game which has all the advantages of the prior art card games and none of the disadvantages.

It is another object of the present invention to provide a new and improved pick-a-card game which may be easily and efficiently manufactured and marketed.

It is a further object of the present invention to provide a new and improved pick-a-card game which is of a durable and reliable construction.

An even further object of the present invention is to provide a new and improved pick-a-card game which is susceptible of a low cost of manufacture with regard to both materials and labor, and which accordingly is then susceptible of low prices of sale to the consuming public, thereby making such pick-a-card games economically available to the buying public.

Still yet another object of the present invention is to provide a new and improved pick-a-card game which provides in the apparatuses and methods of the prior art some of the advantages thereof, while simultaneously overcoming some of the disadvantages normally associated therewith.

Still another object of the present invention is to provide a new and improved pick-a-card game wherein the same permits random and gaming selection of a predetermined number of cycles to be played by a plurality of players, and where various and differing goals in selection of a card are continuously determined in a subjective manner by sequential dealers of the cards.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is an isometric illustration of the gaming dice utilized by the instant invention.

FIG. 3 is an isometric illustration of the representative gaming money utilized by the instant invention.

FIG. 4 is an orthographic plan view of a first score card utilized by the instant invention.

FIG. 5 is an orthographic plan view of a second scoring card utilized by the instant invention.

DESCRIPTION OF THE PREFERRED EMBODIMENT

Figure 1:
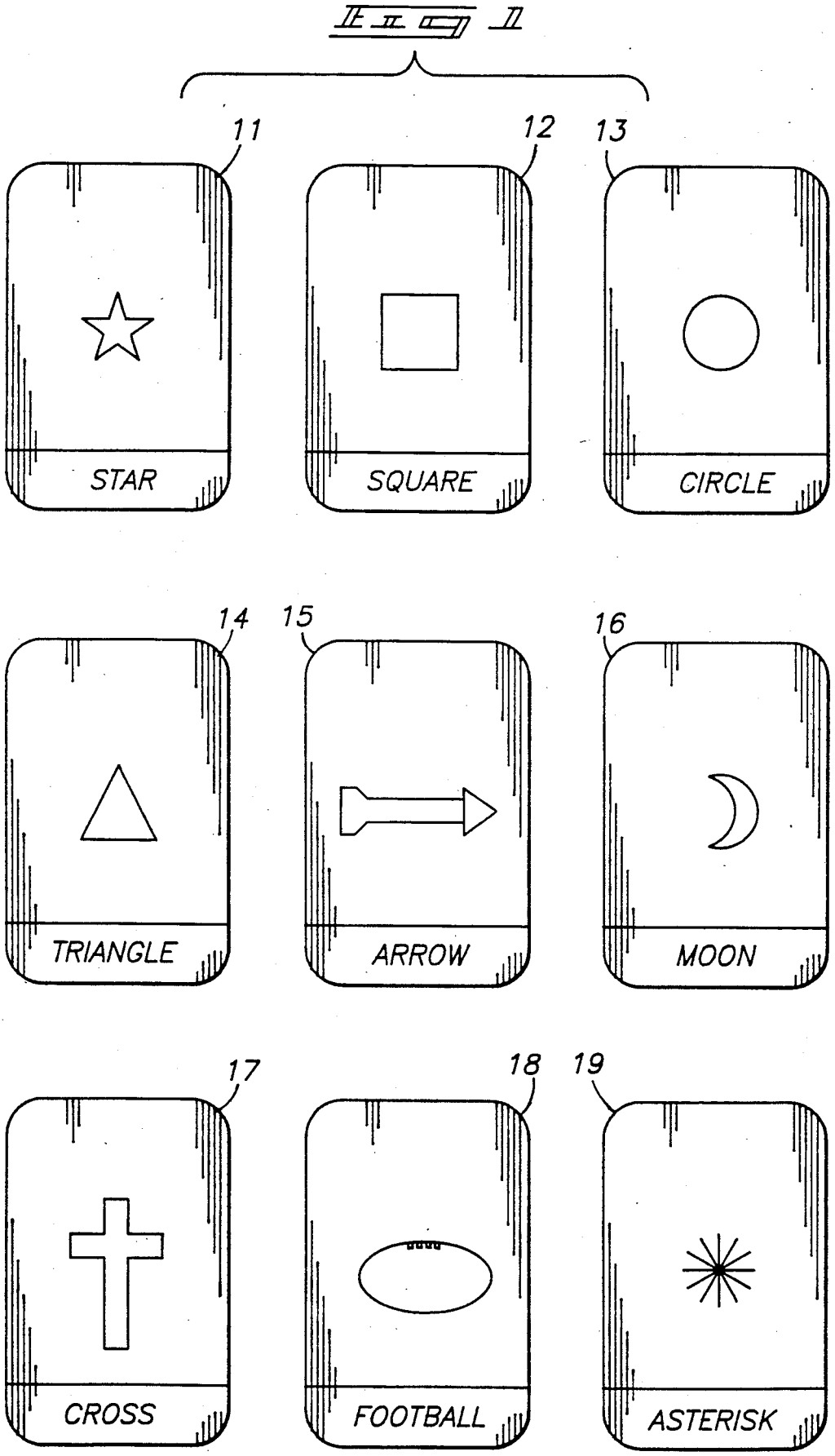
FIG. 1 is a top orthographic plan view of cards utilized by the instant invention.

With reference now to the drawings, and in particular to FIGS. 1 to 5 thereof, a new and improved pick-a-card game embodying the principles and concepts of the present invention and generally designated by the reference numerals 11–30 will be described.

More specifically, the game of the instant invention essentially comprises playing cards as illustrated in FIG. 1 using coordination with gaming members or dice 20 utilizing representative money 21. The cards include a first, second, third, fourth, fifth, sixth, seventh, eighth, and ninth playing card 11–19 respectively, wherein each of the cards is representative of a different symbol, with the symbol described at a lowermost portion of the card. Each reverse side of each card 11–19 is of a same symbology, or may in fact even be blank, to disguise the forward faces, as illustrated in FIG. 1 of the cards 11–19. A plurality of players are required in the play of the game of the instant invention, and a number of two to eight is required. Scoring may be effected by one of the players, an independent judge, or electronically, utilizing contemporary circuitry, as set forth by the prior art for example and incorporated herein by reference to U.S. Pat. No. 4,380,334 in particular, providing imperative and scoring circuitry to provide immediate accumulation of scoring and determination of ranking among players of a current scoring situation. Players are positioned in a circular array, and each of the players is designated as a dealer in a sequential manner. Upon completion of each player as a dealer, a cycle of play is effected. Prior to commencement of the game, a predetermined number of cycles of play are determined. The dice 2 may be utilized and thrown to determine the number of cycles, i.e. two to twelve. Further, the dice are then sequentially thrown by each player to determine the initial dealer.

Each dealer subsequent to shuffling of the cards 11–19 subjectively determines a goal card to be picked by an adjacent player. The goal card is then returned to the deck of cards and the dealer shuffles the cards again. The dealer then requests the player to the dealer's immediate right to select the predetermined goal card as requested by the dealer. Inasmuch as nine potential draws are possible by the adjacent player to select a proper card, scoring totals are awarded on that basis. More specifically, the representative money 21 is utilized as either reward or punishment for the player selecting cards. The player selecting cards selecting correctly upon the first attempt is awarded the equivalent of four of the denominations of the representative money 21. The representative money 21 is typically in one hundred dollar denominations, and accordingly four hundred dollars is awarded. A second correct choosing upon a first failure is awarded three hundred dollars, a third correct choosing is awarded two hundred dollars, a fourth correct choosing is awarded one hundred dollars to the selecting player. A player selecting the required goal card on the fifth attempt is awarded no points. Subsequently, the selecting player selecting the required card on the respective sixth, seventh, eighth, and ninth attempts is required to pay respectively one hundred dollars, two hundred dollars, three hundred dollars, and four hundred dollars respectively to the current dealer. In preliminary preparation for the game, the representative money is distributed dependent upon the number of arbitrary cycles chosen as noted above. Inasmuch as four hundred dollars of representative money may be exchanged on a single turn, each player is awarded the equivalent of four hundred dollars or four bills of representative money times twice the number of cycles. For example, if eight cycles are chosen, each player is awarded four hundred times sixteen cycles or sixty-four hundred dollars.

The player with the greatest accumulation of money at the culmination of the predetermined number of cycles is declared the winner. In the event of a tie, players involved must each be provided one more turns each in an attempt to declare an ultimate winner. If in the tie stage a player is left without any representative money, the player in the event of selecting a card and being required to pay a predetermined amount, must borrow that amount from the bank or storage of the money from the game but debt will be recorded against that player.

FIG. 4 illustrates a representative board, or first scoring card 22, mounted upon an erasable rigid surface. A player column 24 is provided to receive insertion of a player name, wherein a turn column 25 keeps a running total of the number of turns that player has been involved with and accordingly determines the number of cycles that player has participated in. The points column 26 provides a points or total of money 1 as noted above, wherein the points lost column 27 determines the number of points or dollars lost. Each point is representative of the individual denomination or one hundred dollar goal of each bill of the representative money 21. The resultant column 28 provides a resultant number of representative dollars that player is advantage or disadvantage of, i.e. in debt or in a positive relationship relative to the representative money. The ranking column 29 illustrates the ranking of each player from the leader to the subsequent players in their sequential standing within the game in terms of money accumulated or lost. The second scoring card 23 is advantageously utilized in an electronic representation of the game wherein in addition to the columns as illustrated and described in FIG. 4, the points accumulation column 26 is divided into four subcolumns, wherein each subcolumn is provided with a gradation of the number of points or represented money denominations that player may have won from plus four to plus one. An additional draw column 30 is provided to indicate that that player has participated in a turn with a neutral result, i.e. that player has selected a proper card upon the fifth attempt. The points lost column 27 provides for subcolumns from negative one to negative four points or dollar denominations dependent upon whether the player has picked correctly in the sixth through ninth turn. The points are then tabulated in a resultant manner in the resultant points column 28 and ranking column 29, wherein these columns are automatically tabulated by conventional comparative circuitry utilized in available memory and tabulation circuits available in the prior art.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method of playing a card game comprising the steps of, providing a deck of predetermined number of cards each card being distinguishably identifiable wherein each card has a distinct geometric symbol upon a forward face of each card, and providing a plurality of gaming dice, and providing a scorekeeping board, and providing a predetermined number of individual bills of representative money, and each bill of an equal denomination, and selecting a predetermined number of players, and each player of the predetermined number of players sequentially throwing the dice and obtaining a representative number, a highest number of the representative number determining an initial dealer, and each of the predetermined number of players obtaining a sequential turn as a dealer subsequent to the initial dealer, and defining a cycle when each player effects a turn as a dealer, and arbitrarily determining a predetermined number of cycles, and each player sequentially shuffling the cards as a dealer and subjectively selecting a single representative card of the predetermined number of cards, and said dealer returning said representative card to the deck of cards and shuffling the cards again, and said dealer requesting said adjacent player to select a card in an attempt to select said representative card, and awarding bills of the predetermined number of bills to the dealer or to the adjacent player based upon success of the adjacent player selecting the single representative card, and tabulating the recording of the predetermined number of bills upon the scorekeeping card.

2. A method as set forth in claim 1 wherein nine playing cards are provided, and the adjacent player is awarded nine potential turns to properly select the single respective card of the predetermined number of cards, and selection of the single representative card upon a first turn of the adjacent player awards the adjacent player four bills, selection of the single respective card upon a second turn award the adjacent player three bills, selection of the representative card upon a third turn awards the adjacent the player two bills, selection of the respective card upon a fourth turn awards the adjacent player one bill, selection of the respective card upon a fifth turn results in no award of bills, selection of the representative card upon a sixth turn awards the dealer a bill by the adjacent player, selection of the respective card upon a seventh turn awards the dealer two bills by the adjacent player, selection of the respective card upon an eighth turn awards the dealer three bills by the adjacent player, and selection of the respective card upon a ninth turn by the adjacent player awards the dealer four bills by the adjacent player.

3. A method as set forth in claim 2 wherein the predetermined number of cycles are selected upon a throwing of the dice to determine the predetermined number of cycles, and each player is awarded four bills times the number of cycles of the predetermined number of cycles at an outset of the game.

4. A method as set forth in claim 3 wherein the step of providing a scorekeeping board includes the step of providing the scorekeeping board with a first column for inserting a name of each player, a second column for record keeping of a number of cycles of the predetermined number or cycles each player has participated in, a third column to maintain a number of bills awarded each player, a fourth column to determine a number of bills lost by each player, a fifth column to determine a resultant number of bills accumulated or lost by each player, and a sixth column to determine a ranking of each player among the players wherein the ranking is dependent upon the fifth column, wherein a greater number of bills accumulated determines a greater ranking within the sixth column.

* * * * *